US005123818A

United States Patent [19]

Gormley et al.

[11] Patent Number: 5,123,818

[45] Date of Patent: Jun. 23, 1992

[54] ROLLING ROTOR MOTOR DRIVEN SCROLL COMPRESSOR

[75] Inventors: Thomas P. Gormley, Liverpool; James F. Crofoot, Kirkville, both of N.Y.

[73] Assignee: Carrier Corporation, Syracuse, N.Y.

[21] Appl. No.: 695,354

[22] Filed: May 3, 1991

Related U.S. Application Data

[63] Continuation of Ser. No. 331,786, Apr. 3, 1989, abandoned.

[51] Int. Cl.[5] ..... F04C 18/02

[52] U.S. Cl. ..... 417/410; 418/55.3; 418/60

[58] Field of Search ..... 417/410; 418/55.3, 60

[56] References Cited

U.S. PATENT DOCUMENTS

| | | | |
|---|---|---|---|
| 2,561,890 | 7/1951 | Stoddard | 103/118 |
| 3,560,118 | 2/1971 | Busch et al. | 418/55 |
| 4,192,152 | 3/1980 | Armstrong et al. | 62/402 |
| 4,553,913 | 11/1985 | Morishita et al. | 418/55 |
| 4,832,586 | 5/1989 | Emmenthal et al. | 418/55 |
| 4,867,652 | 9/1989 | Gormley | 417/353 |
| 4,950,135 | 8/1990 | Tojo et al. | 417/410 |
| 5,002,470 | 3/1991 | Gormley et al. | 417/410 |

FOREIGN PATENT DOCUMENTS

| | | | |
|---|---|---|---|
| 57-76202 | 2/1982 | Japan | 418/60 |
| 60-182382 | 9/1985 | Japan | 418/55 B |

*Primary Examiner*—Richard A. Bertsch
*Assistant Examiner*—David W. Scheuermann

[57] ABSTRACT

The orbiting scroll element of a scroll compressor is integral with the rotor of an internal stator rolling rotor motor. Anti-rotation means are provided to limit the rotor and orbiting scroll to orbiting motion.

6 Claims, 5 Drawing Sheets

ROLLING ROTOR MOTOR DRIVEN SCROLL COMPRESSOR

This application is a continuation of application Ser. No. 07/331,786, filed Apr. 3, 1989, now abandoned.

BACKGROUND OF THE INVENTION

A rolling rotor motor is one in which only a portion of the windings are activated at any given time and the resultant asymmetric magnetic field is moved around the stator by changing which ones of the windings are the activated windings. This type of motor is characterized by high torque and low speed. Where the rotor is located internally of the stator, the coaction between the rotor and stator as a result of the asymmetric magnetic field, unless otherwise limited, is like that of the piston and cylinder of a rolling piston or reciprocating vane type compressor. As a result, the rotor may also be the piston of a rolling piston compressor such as is disclosed in U.S. Pat. No. 2,561,890. Since the rotor rolls around the stator, there are low bearing loads as compared to a motor in which the rotor is constrained to rotate about a fixed axis.

The rolling rotor motor can be integral with the compressor thereby reducing the size and number of parts such as shafts and bearings, but it has some inherent disadvantages. Because only some of the windings are activated at any particular time, the output torque per pound of motor weight is less than it would be for an induction motor. Also, the rotor is dynamically unbalanced since its center traces a circular orbit as it moves circumferentially towards the activated windings due to magnetic attraction as it follows the rotating field. The unbalance forces increase with the square of the rotor speed thus making the motor unsuitable for high speed applications.

SUMMARY OF THE INVENTION

An external rotor is made integral with the orbiting scroll of a scroll compressor. The normally hypocycloidal relationship between the rotor and stator is changed by limiting the rotor, and therefore the orbiting scroll, to an orbiting motion. To better balance the compressor, an orbiting scroll is preferably located at each end of the rotor. This also permits the axial separation forces between each orbiting scroll and its corresponding fixed scroll to cancel. The anti-rotation device permits the radial movement of the rotor for pressure relief as where a liquid slug is encountered.

It is an object of this invention to convert hypocycloidal motion to orbiting motion.

It is another object of this invention to provide a simplified drive for a scroll compressor while maintaining full radial compliance.

It is further object of this invention to permit the rolling rotor to change its radius of operation. These objects, and others as will become apparent hereinafter, are accomplished by the present invention.

Basically, at least one orbiting scroll element is affixed to the rotor of an internal stator, rolling rotor motor so as to be moveable therewith. A low friction interface between the orbiting scroll and the rolling rotor would allow the rotor to roll around the stator producing hypocycloidal motion, which is a combined oscillating and rotating motion, but for the provision of anti-rotation means which prevents the orbiting scroll from rotating. The resulting motion of the orbiting scroll is pure oscillatory motion. Because they are integral, the inherent radial compliance of the rolling rotor is transferred to the orbiting scroll.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
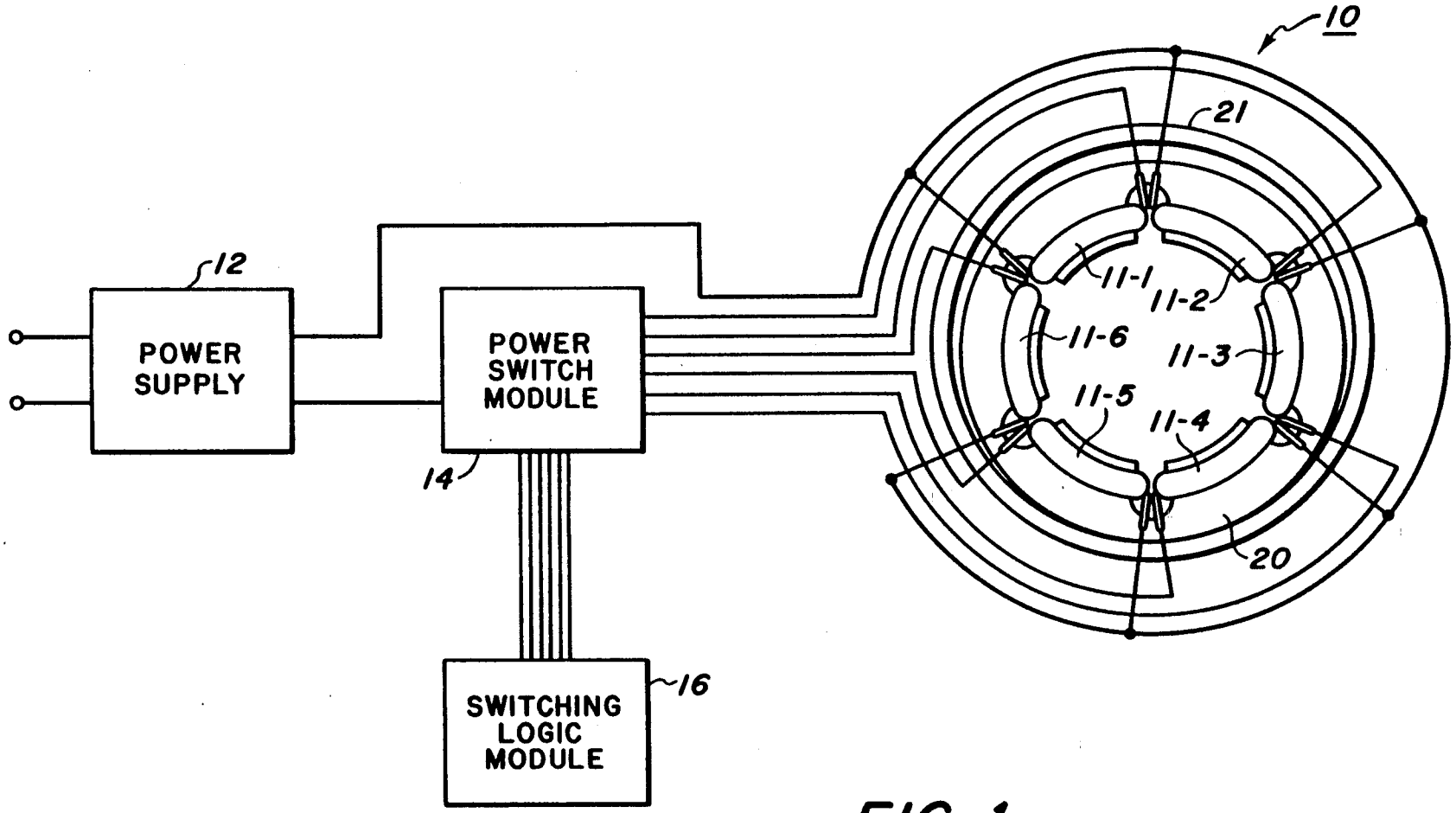
FIG. 1 is a circuit diagram for a rolling rotor motor/-compressor.
Figure 2:
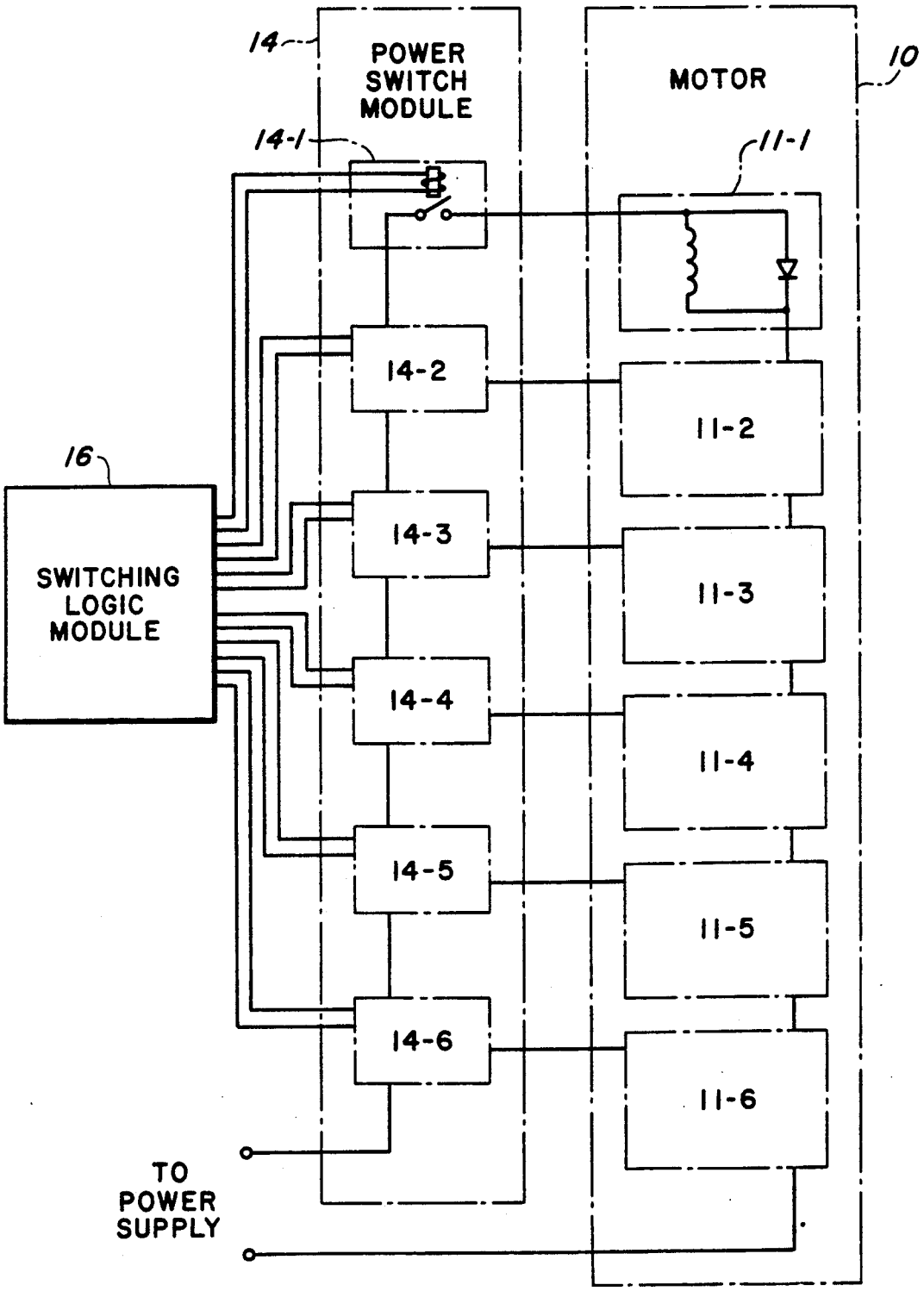
FIG. 2 is a more detailed view of the switching portion of the circuit of FIG. 1.
Figure 3:
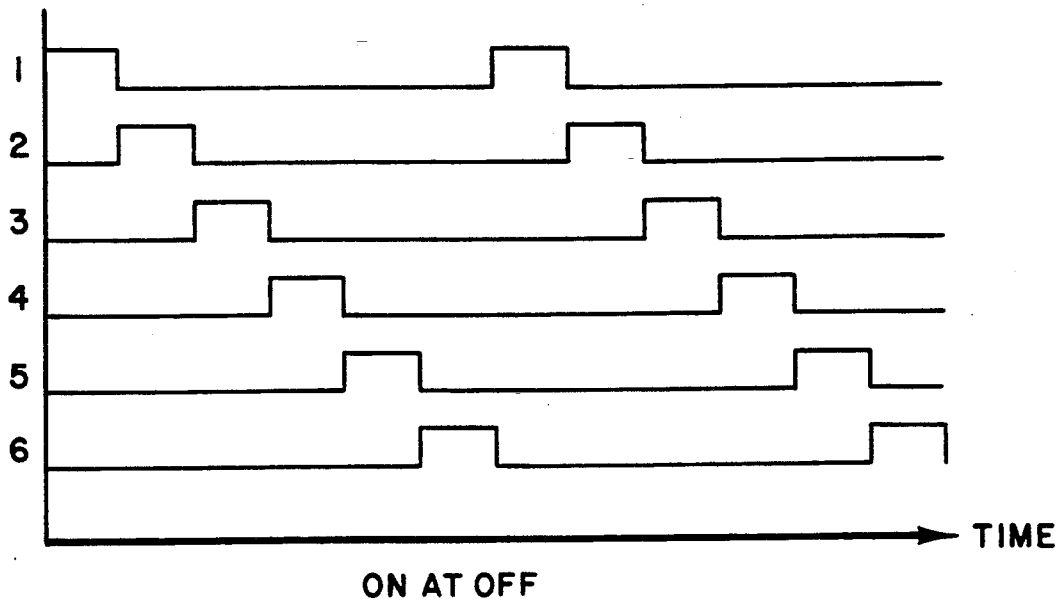
FIG. 3 is a graph showing the actuation of the switches as a function of time in the on at off mode.
Figure 4:
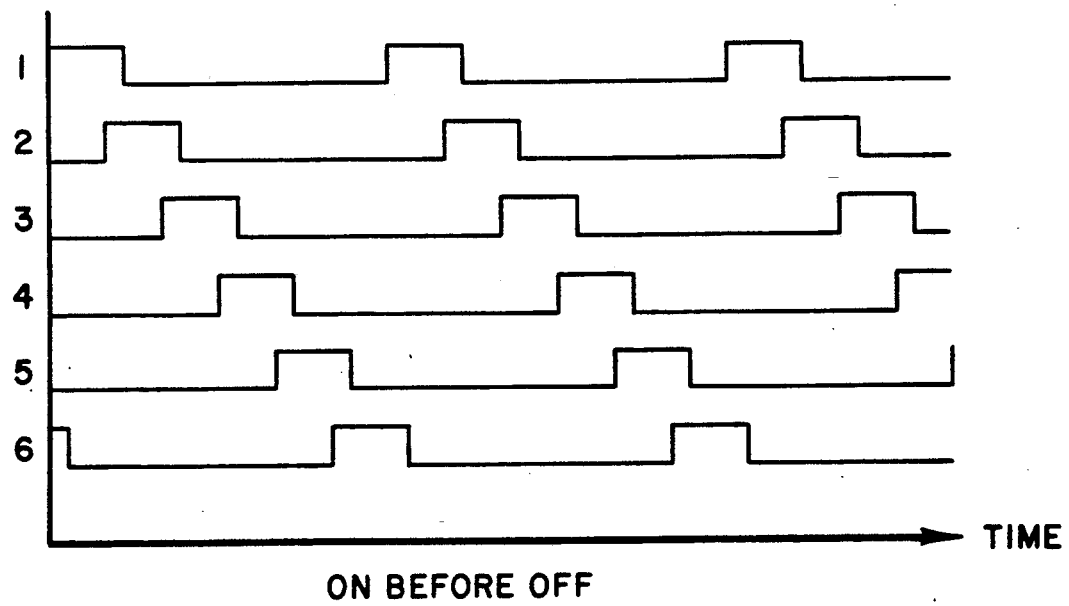
FIG. 4 is a graph showing the actuation of the switches as a function of time in the on before off mode.

In FIG. 1 the numeral 10 generally designates a rolling rotor motor driven hermetic scroll compressor which has a plurality of windings with six, 11-1 to 6, being illustrated. Power from power supply 12 is supplied to windings 11-1 to 6 by power switch module 14 under the control of switching logic module 16. Referring to FIG. 2, it will be noted that the power supply 12 is connected to windings 11-1 to 6 through switches 14-1 to 6 which are controlled by switching logic module 16. Switch 14-1 is illustrated as solenoid actuated but any suitable power switching may be employed. Switches 14-1 to 6, as illustrated in FIG. 3, can be actuated in an "on at off" mode wherein the shutting off of power to one winding coincides with the supplying of power to the next winding. Alternatively, as illustrated in FIG. 4, switches 14-1 to 6 can be actuated in an "on before off" mode wherein power is supplied to a winding for a short period of time after power is supplied to the next winding.

Figure 5:
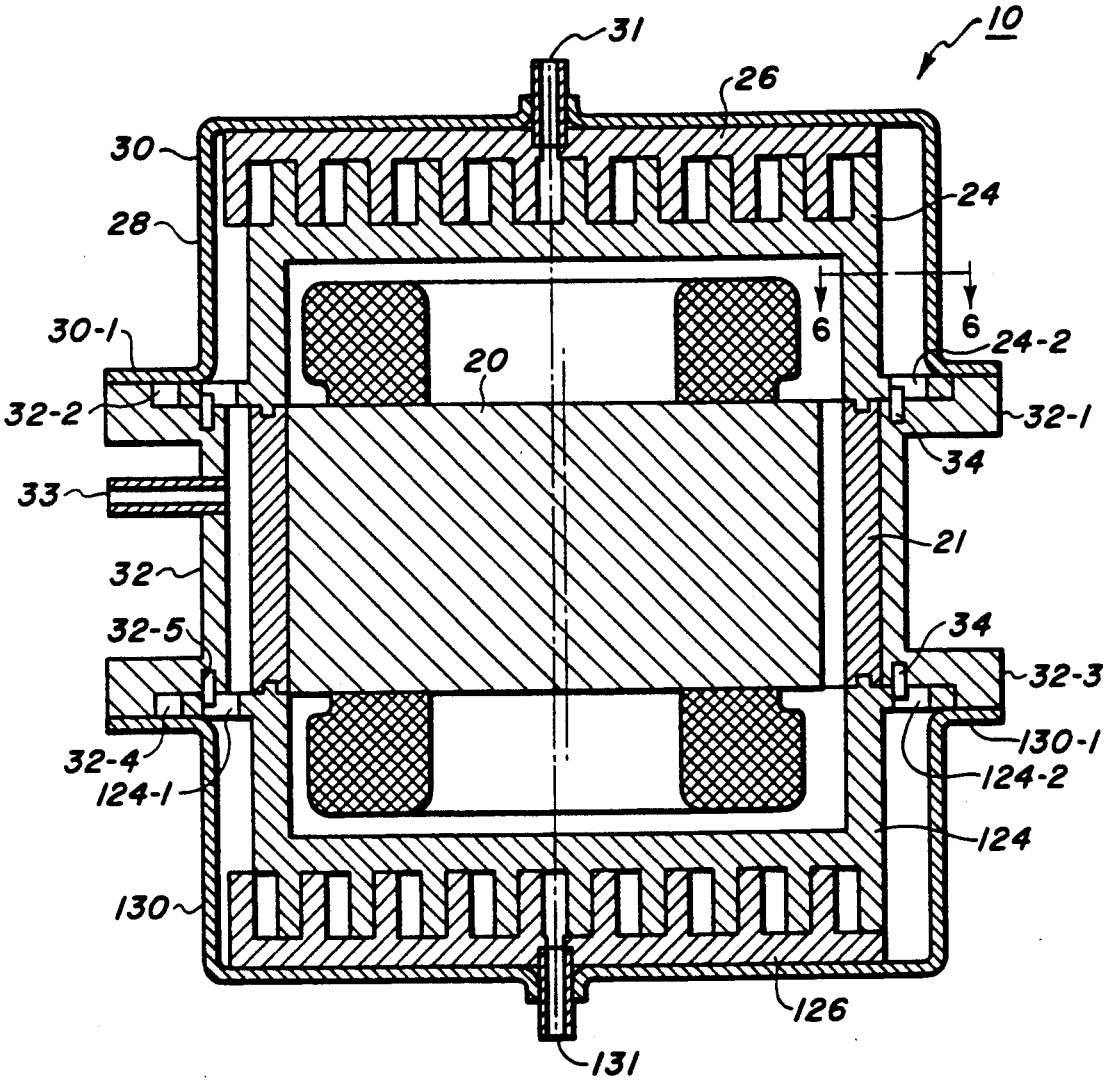
FIG. 5 is a vertical section of a rolling rotor motor driven scroll compressor.

In FIGS. 1 and 5, the numeral 10 generally designates a rolling rotor motor driven scroll compressor which includes a stator 20 with windings 11 and an annular rotor 21. Hermetic shell 28 is made up of top shell 30, middle shell 32 and bottom shell 130. Top shell 30 has fixed scroll 26 fixedly secured thereto and has outlet 31 extending therethrough. Similarly, bottom shell 130 has fixed scroll 126 fixedly secured thereto and has outlet 131 extending therethrough. Inlet 33 extends through middle shell 32. Middle shell 32 includes a pair of end flanges 32-1 and 32-3, respectively, having annular recesses 32-2 and 4, respectively. Axial bores 32-5 are made in annular recesses 32-2 and 4 at 90° spacings and receive pins 34 which extend therefrom.

Figure 6:
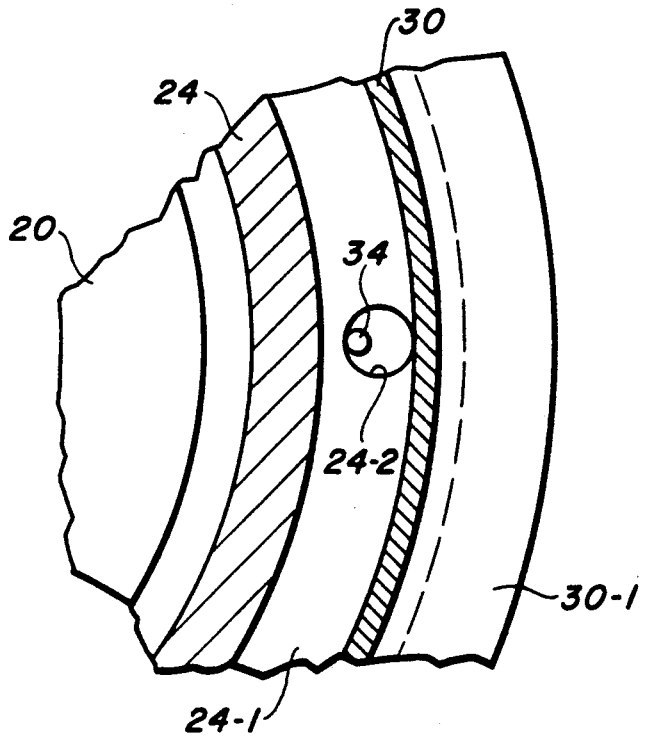
FIG. 6 is a partial sectional view taken along line 6—6 of FIG. 5.

Top shell 30 has a flange 30-1 which is sealed to flange 32-1 by welding, bolting or any other suitable method and overlies at least a portion of annular recess 32-2. Similarly, bottom shell 130 has a flange 130-1 which is sealed to flange 32-3 by welding, bolting or any other suitable method and underlies at least a portion of annular recess 32-4. Orbiting scroll 24 has a flange 24-1 having axial holes 24-2 located at 90° spacing and of a size corresponding to the orbit of orbiting scroll 24, as best shown in FIG. 6. Flange 24-1 extends into recess 32-2 between flanges 30-1 and 32-1. Pins 34 extend into each axial hole 24-2. Similarly, orbiting scroll 124 has a flange 124-1 having axial holes 124-2 located at 90° spacing and of a size corresponding to the orbit of orbiting scroll 124. Flange 124-1 extends into the recess 32-4 between flanges 32-3 and 130-1. Pins 24 extend into each axial 124-2.

In operation of the rolling rotor motor, as the magnetic field moves about the stator 20 through the selective activation of some of the windings, as described above, annular rotor 21 tends to follow the magnetic field and coacts with the stator 20 in the manner of the coaction of the piston and cylinder of a rolling piston compressor. The annular rotor 21 thus tends to rotate about the stator 20 together with orbiting scrolls 24 and 124 which are integral with annual cylindrical rotor 21. Because pins 34 are received in and coact with holes 24-2 and 124-2, the movement of annular rotor 21 together with integral orbiting scrolls 24 and 124 is limited to an orbiting motion in a circle the size of holes 24-2 and 124-2. The holes 24-2 and 124-2 will, therefore, be sized for the desired orbiting circle of orbiting scrolls 24 and 124.

For compressor operation, refrigerant at suction pressure is supplied from the refrigeration system (not illustrated) to the interior of shell 28 via inlet 33. Refrigerant in shell 28 is trapped between the wraps of orbiting scroll 24 and 124 and their corresponding fixed scrolls 26 and 126 and compressed and supplied via outlets 31 and 131, respectively, to the refrigeration system (not illustrated) in the conventional manner for a scroll compressor. As is conventional in the scroll compressor, the pressure of the gas being compressed tends to separate the coacting fixed and orbiting scrolls and exerts an axial separation force. However, since both of the orbiting scrolls 24 and 124 are integral, the separation of one can only take place if the other comes closer to its fixed scroll so that the separation forces are offset thereby eliminating the high bearing loads.

If a liquid slug, for example, was in the trapped volume between the scroll wraps of the compressor, its incompressibility would create an excess pressure. Because holes 24-2 and 124-2 coact with pins 34, rotor 21 and integral orbiting scrolls 24 and 124 can move away from the wall of stator 20, and the fixed scrolls 26 and 126 thereby unsealing the trapped volume and permitting the rotor 21 and/or orbiting scrolls 24 and 124 to override the liquid slug, grit, etc.

Although preferred embodiments of the present invention have been illustrated and described, other changes will occur to those skilled in the art. Although eight of pins 34 are disclosed, a smaller number may be used and they may be all in either flange 32-1 or 32-3 or two in each, for example. Also, it is not necessary to use two pairs of scrolls. It is therefore intended that the scope of the present invention is to be limited only by the scope of the appended claims.

What is claimed is:

1. A hermetic scroll compressor comprising:

a shell means having supply means for delivering refrigerant thereto and discharge means for supplying compressed refrigerant therefrom;

rolling rotor motor means including a stator and an annular rotor located within said shell means;

fixed scroll means located within and fixedly secured with respect to said shell means;

orbiting scroll means integral with said rotor so as to be movable therewith as a unit; and means for restricting movement of said rotor to an orbiting motion.

2. The hermetic scroll compressor of claim 1 wherein said fixed and orbiting scroll means each includes two scrolls.

3. The hermetic scroll compressor of claim 1 wherein said means for restricting movement includes a flange on said orbiting scroll means with one or more holes therein which coacts with a corresponding pin fixedly secured within said shell means so as to restrict movement of said annular rotor and said integral orbiting scroll means to orbiting motion.

4. The hermetic scroll compressor means of claim 3 wherein said corresponding one or more holes and pins coact to permit relative radial movement of said rotor and integral orbiting scroll means to accommodate a liquid slug.

5. A hermetic scroll compressor comprising:

generally cylindrical shell means having a first and second end and including inlet means for supplying refrigerant gas and discharge means for supplying compressed refrigerant gas therefrom;

rolling rotor motor means within said shell means and including a stator and an annular, cylindrical rotor surrounding said stator;

fixed scroll means located within and fixedly secured with respect to said shell means at said first end;

orbiting scroll means integral with said rotor so as to be movable therewith as a unit and coacting with said fixed scroll means at said first end to compress refrigerant gas; and means for restricting movement of said rotor and integral orbiting scroll means to an orbiting motion.

6. The hermetic scroll compressor of claim 5 further including:

fixed scroll means located within and fixedly secured with respect to said shell means at said second end; and orbiting scroll means integral with said rotor and coacting with said fixed scroll means at said second end to compress refrigerant gas.

* * * * *